US007354382B1

(12) United States Patent
Warren, II

(10) Patent No.: US 7,354,382 B1
(45) Date of Patent: Apr. 8, 2008

(54) WHEELED AMBULATION AND LIFTING APPARATUS

(76) Inventor: Coy L. Warren, II, P.O. Box 416, Hagerman, NM (US) 88232

( * ) Notice: Subject to any disclaimer, the term of this patent is extended or adjusted under 35 U.S.C. 154(b) by 239 days.

(21) Appl. No.: 10/855,195

(22) Filed: May 27, 2004

Related U.S. Application Data

(60) Provisional application No. 60/473,496, filed on May 27, 2003.

(51) Int. Cl.
*A63B 21/00* (2006.01)

(52) U.S. Cl. ..... 482/68; 482/69

(58) Field of Classification Search ..... 482/69, 482/68; 135/65, 67; 280/87.1, 87.05, 828; 180/65.1; 5/89.1; 601/5, 35
See application file for complete search history.

(56) References Cited

U.S. PATENT DOCUMENTS

| | | | | |
|---|---|---|---|---|
| 1,611,807 | A | 12/1926 | Bergh | |
| 2,327,671 | A | 8/1943 | Ruprecht | |
| 2,362,466 | A | 11/1944 | Carter | |
| 2,625,202 | A * | 1/1953 | Richardson et al. | 482/68 |
| 2,719,568 | A | 10/1955 | Webb | |
| 2,745,465 | A | 5/1956 | Hogan | |
| 2,792,052 | A | 5/1957 | Johannesen | |
| D181,957 | S | 1/1958 | Callahan | |
| 3,252,704 | A * | 5/1966 | Wilson | 482/68 |
| 3,778,052 | A | 12/1973 | Andow et al. | |
| 4,187,869 | A * | 2/1980 | Marchetti | 135/67 |
| 4,188,966 | A | 2/1980 | Palmer et al. | |
| 4,266,765 | A | 5/1981 | Sandoval et al. | |
| 4,748,994 | A | 6/1988 | Schultz et al. | |
| 4,844,452 | A | 7/1989 | Tomosky et al. | |
| 4,941,497 | A | 7/1990 | Prather et al. | |

(Continued)

FOREIGN PATENT DOCUMENTS

| | | |
|---|---|---|
| CH | 416940 | 7/1966 |
| GB | 579543 | 8/1946 |

OTHER PUBLICATIONS

"TFP & TFT Metal Lined Pipe & Tubing"; Internet brochure of Kuroki Tube and Pipe Co., LTD.; pp. 1-8

(Continued)

*Primary Examiner*—Jerome Donnelly
(74) *Attorney, Agent, or Firm*—Deborah A. Peacock; Justin R. Jackson; Peacock Myers, P.C.

(57) ABSTRACT

The present invention relates to a wheeled ambulation, exercise, and lifting apparatus for lifting patients with compromised strength in the legs and for allowing such patients to be mobile with access to a variety of facilities.

16 Claims, 3 Drawing Sheets

U.S. PATENT DOCUMENTS

| | | | | |
|---|---|---|---|---|
| 5,380,262 | A * | 1/1995 | Austin | 482/68 |
| 5,467,793 | A | 11/1995 | Hart | |
| 5,476,432 | A | 12/1995 | Dickens | |
| 5,502,851 | A | 4/1996 | Costello | |
| 5,526,893 | A * | 6/1996 | Higer | 180/65.1 |
| 5,599,260 | A | 2/1997 | Rovinsky et al. | |
| 5,603,677 | A | 2/1997 | Sollo | |
| 5,662,560 | A * | 9/1997 | Svendsen et al. | 482/69 |
| 5,702,326 | A | 12/1997 | Renteria | |
| 6,175,973 | B1 * | 1/2001 | Hakamiun et al. | 5/89.1 |

OTHER PUBLICATIONS

"Clad Line Pipe for Oil & Gas Fields"; Sumitomo Metal Industries, LTD.; No. 14421/Printed in Japan by New Market Inc./2; 7 pages.
3 G Position Welding by DPS-CII GTAW Process; 1 page.
"Where Toughness Counts Most, High Nickel-Clad Welded Pipe with Superior Anti-Corrosion Properties"; 1 page; NKK Corporation, Tokyo, Japan.
C-II—For New Transportation System; Nippon Steel; 4 pages.
"Butting—Bimetal Corrosion Resistant Pipes"; The Website for the Chemicals Industry; 2 pages.

* cited by examiner

WHEELED AMBULATION AND LIFTING APPARATUS

This application claims the benefit of the filing of U.S. Provisional Patent Application Ser. No. 60/473,496 entitled "Wheel Walker", filed on May 27, 2003, and the specification thereof is incorporated herein by reference.

BACKGROUND OF THE INVENTION

1. Field of the Invention (Technical Field)

The present invention relates to a wheeled ambulation, exercise, and lifting apparatus.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Many patients with compromised mobility require the ability to move about and many require physical therapy involving standing and walking. Many such patients also require assistance in lifting themselves up. Care-givers often need assistance in helping lift the patient.

Previous devices have incorporated various harness designs that can support a patient's weight. However, those are limited in their ability to allow easy access to the bedside, chairs, wheeled chairs, exercise units, etc. Their often complicated design also prevents the often required versatility.

Such devices include those disclosed in U.S. Pat. No. 5,603,677 (to Sollo) which describes a walker designed to use counterbalance weights to help the user stand. The device is not suited to lifting a patient from a sitting or lying position. The device disclosed in U.S. Pat. No. 5,502,851 (to Costello) is a lifting as well as standing and walking device, but is not suited for lifting a patient from a variety of positions, including a lying position, and requires the use of a complicated body harness that inhibits ease of use. Also, a user can face only one direction relative to the device, thereby limiting accessibility to a patient. The device described in U.S. Pat. No. 3,353,704 (to Wilson) is a lifting and walking jacket that also requires the use of a complicated body harness that inhibits ease of use. Other devices such as those disclosed in U.S. Pat. No. 5,702,326 (to Renteria), U.S. Pat. No. 5,526,893 (to Higer), and U.S. Pat. No. 2,719,568 (to Webb), are designed to help a patient maintain a standing position or walk, but do not provide for lifting a patient.

None of the cited references disclose devices that offer the versatility to allow a patient access to, and use of, a variety of facilities such as bath and bathroom facilities, negotiate crowded locations, and approach and position a patient from various directions.

BRIEF SUMMARY OF THE INVENTION

The present invention comprises an ambulation, exercise, and lifting device comprising a base frame open on a side thereof, a plurality of wheels attached to an underside of the base frame, a vertical support column adjustable in height, two horizontal handles disposed on the vertical support column, an overhead support arm pivotally disposed at a pivot point on the vertical support column, a body harness support bar disposed on the overhead support arm, and a mechanism to rotate the overhead support arm about the pivot point so that a user may be lifted. The handles are preferably removably attached to the vertical support column and are adjustable with respect to height above a floor. The handles are preferably adjustable in orientation with respect to each other.

The vertical column of the apparatus preferably comprises at least one connecting pin to attach the handles to the vertical support column, and the handles preferably comprise an orifice at one end to attach the handles to the connecting pin. The handles may comprise bracket arms at one end that connect to the vertical support column to support the weight exerted on the handles. The handles may be joined by a connecting arm attached to the vertical support column.

The vertical support column of the apparatus preferably comprises an upper support column slidably and adjustably disposed within a lower support column.

The body harness support bar is preferably pivotally attached to the overhead support arm from a center point along the length of the body harness support bar.

The mechanism to rotate the overhead support arm may comprise a jack, and the jack may be hydraulic or a screw-type jack. The mechanism may comprise a cranking mechanism and a chain. The mechanism may comprise a motor. The motor or other mechanism may be remote controlled.

The apparatus may further comprise a seat. The seat may be foldable. The apparatus may further comprise a plurality of chains adjustable in length disposed on the body harness support bar.

A primary object of the present invention is to facilitate the lifting of a patient with compromised strength in the legs.

Another object is to provide ambulatory assistance to such a patient.

A primary advantage of the present invention is that it greatly eases the burden on the patient and care givers to lift substantial amounts of weight.

Another advantage of the present invention is that it greatly facilitates the mobility of a patient in crowded conditions.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention relates to a wheeled ambulatory, exercise, and lifting apparatus. The apparatus can lift a patient from any position to a higher position. For example, a patient may be lifted from a lying to a standing position and any range in between. The apparatus allows access to the patient from any direction that is open to allow the positioning of the apparatus so that the patient can be easily positioned approximately at the center of the base of the apparatus. The apparatus allows the patient to freely orient herself in any direction within the apparatus, and the apparatus may be wheeled in any direction.

Figure 1:
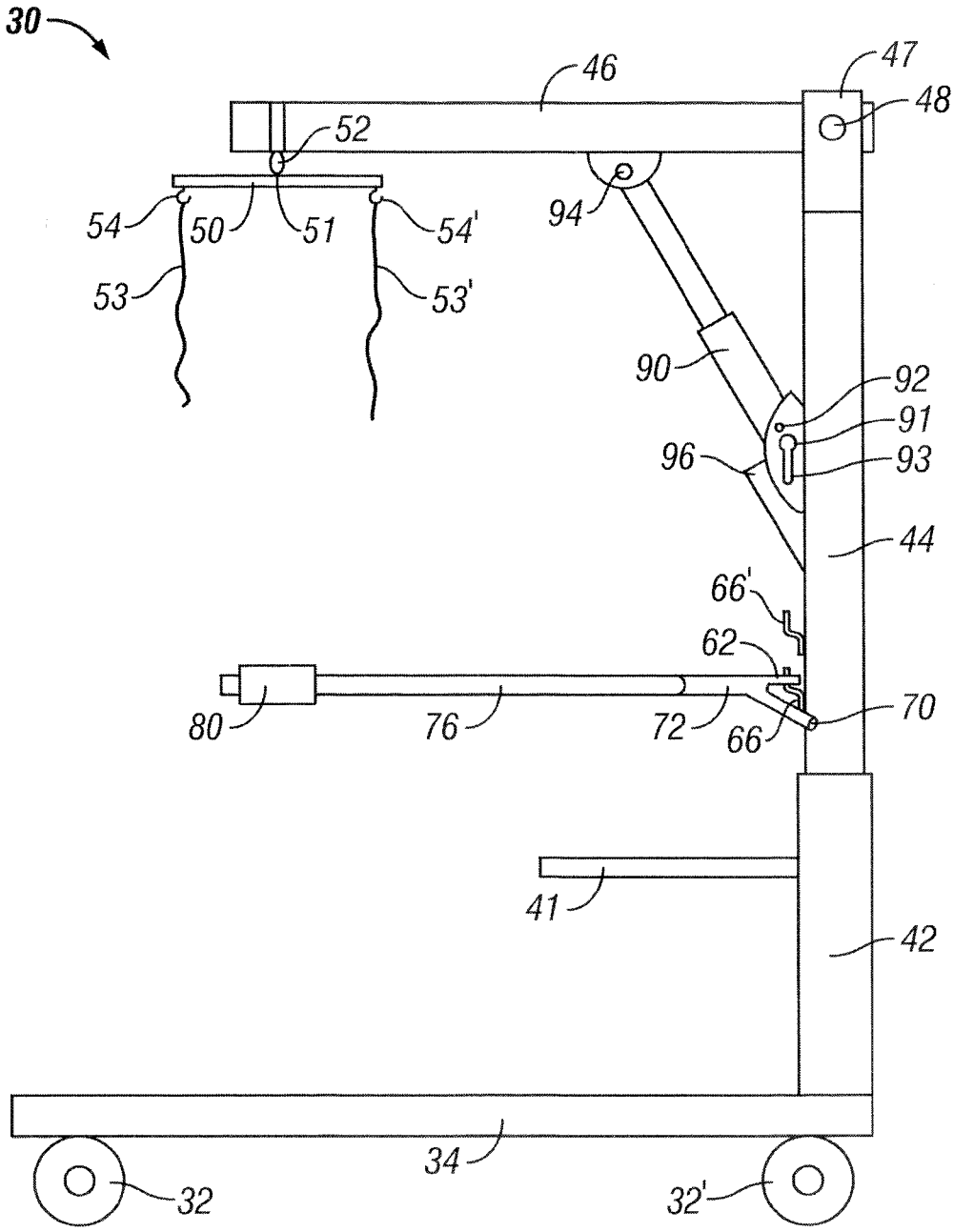
FIG. 1 is a side view of the preferred embodiment of the present invention.

Turning now to the figures, which describe the preferred embodiment of the present invention, FIG. 1 is a side view of apparatus 30. Wheels 32, 32' support base 34 and provide for travel in any direction. Two wheels are shown, but it is understood that any number of wheels may be utilized—four are preferred. It is also understood that any rolling, sliding, or moving mechanism known in the art, such as, for example, rollers or sliders, may substitute for wheels 32, 32'. The term "wheels" as used in the specification and claims is intended to include all such embodiments. Lower vertical support column 42 is attached to base 34. Upper vertical support column 44 is adjustably attached to lower vertical support column 42. Any means for adjustment of the overall combined height of lower vertical support column 42 and upper vertical support column 44 known in the art may be utilized. In the preferred embodiment shown, upper vertical support column 44 is slidably disposed within lower vertical support column 42. Disposed on lower vertical support column 44 is seat 41. Seat 41 is retractable, foldable, or hinged so that it may be set aside when not in use.

Overhead support arm 46 is pivotally attached to support column 44 at pivot point 48 (e.g., via column bracket 47). Column bracket 47 is disposed atop upper vertical support column 44. Body harness attachment bar 50 is attached from attachment point 51 located preferably mid-way along the length of attachment bar 50 via attachment 52 to overhead support arm 46. Attachment 52 may comprise any attachment known in the art that allows attachment bar 50 to pivot freely in a horizontal and lateral orientation. Preferably, attachment bar 50 may pivot only in a horizontal manner to allow the patient (not shown) to rotate to face any direction. A body harness or other supporting device (not shown) attaches to attachment bar 50 at points 54, 54'. Chains 53, 53'adjustable in length may be used to attach a body harness to attachment points 54, 54'. The term "chain" as used in the specification and claims includes, but is not limited to, cables, ropes, wires, and the like. It is understood that any type of body harness may be utilized and attached to body harness bar 50, including, but not limited to, simple straps, hooks, loops and the like, body suits, vests, and the like, depending on the user's requirements. The term "body harness" as used in the specification and claims is intended to include all such embodiments.

Attachment bar 50 may be raised and lowered by rotating overhead support arm 46 about pivot point 48. Bracket 47 permits overhead support arm 46 to move so that the movement of overhead support arm 46 is not hindered by upper vertical support column 44. Rotation of overhead support arm 46 may be accomplished by any means known in the art. Preferably, jack 90, attached to upper vertical support column 44 at point 92 and to overhead support arm 46 at point 94 provides the power to rotate overhead support arm 46 about pivot point 48. Jack 90 may be of any type known in the art such as, for example, hydraulic jacks and screw-type jacks. FIG. 1 shows a screw-type jack operated by cranking mechanism 91 and crank handle 93.

Figure 5:
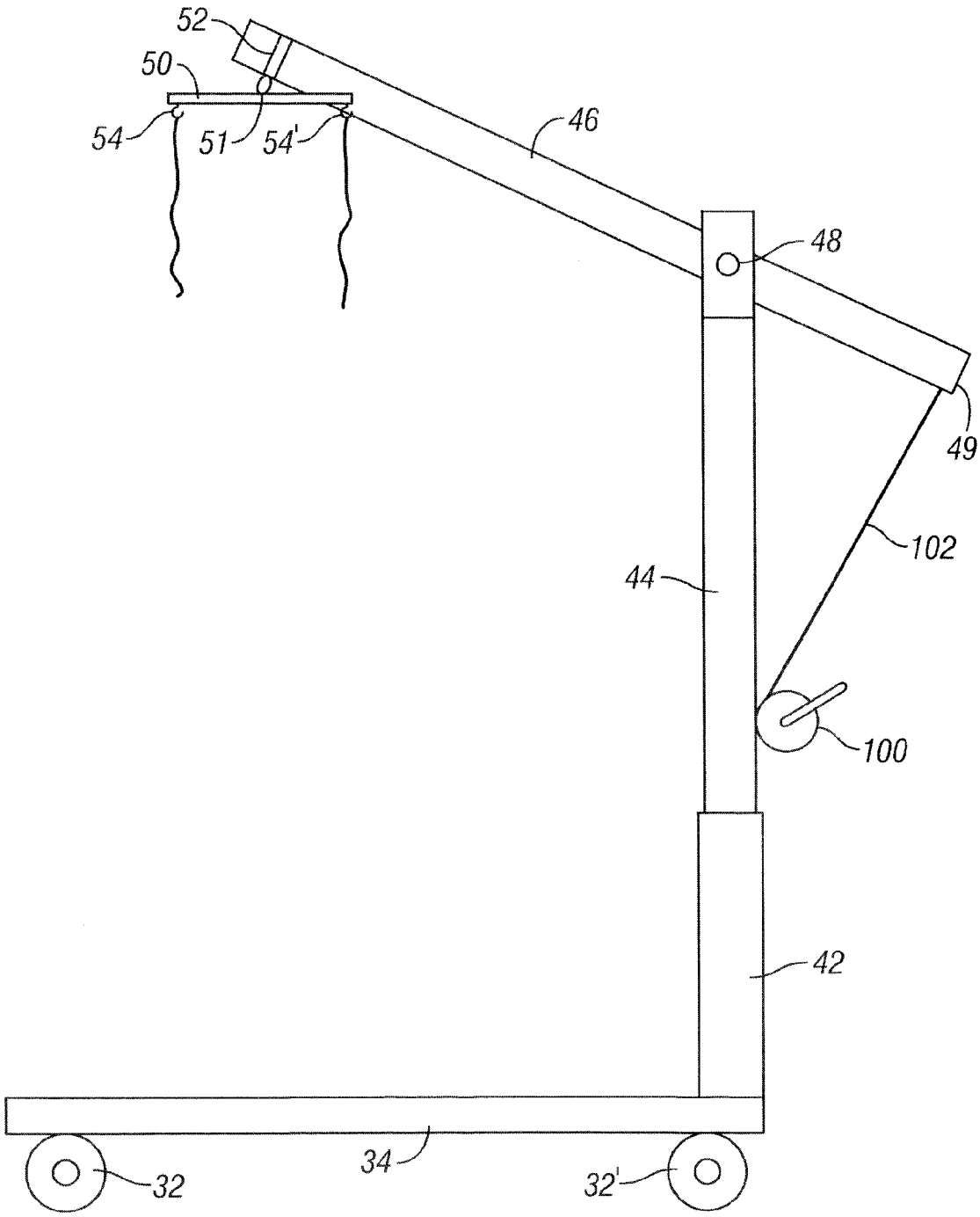
FIG. 5 is a side view of another embodiment of the present invention showing a rear-mounted cranking mechanism to provide lifting power.

FIG. 5 shows another embodiment wherein rear end 49 of upper overhead support arm 46 extends some distance away from upper vertical support column 44 and attaches via cable 102 to rear-mounted crank mechanism 100. Crank mechanism 100, via chain 102, provides the power to rotate overhead support arm 46 about pivot point 48. The term "chain" as used in the specification and claims includes, but is not limited to, cables, ropes, wires, and the like.

In either embodiment described above, utilizing jack 90, crank 100, or any other means to power the lifting of overhead support arm 46, the source of energy may vary by any means known in the art such as human (i.e., manual) energy, electric motorized energy (motor not shown), etc. To provide a patient with the ability to be lifted and be mobile without the aid of care givers, use of motorized mechanism 96 (shown in FIG. 1) is preferable, and mechanism 96 is preferably controlled via a remote operation apparatus (i.e., remote controller, not shown) to offer the patient greater flexibility.

FIG. 1 also shows left handle 76 with hand grip 80. Left handle 76 (and right handle 78, shown in FIG. 3) attach to handle support bar 74 (shown in FIG. 3) as described in more detail below. Connecting pins 66, 66' are disposed on upper vertical support column 44, either from which handle support bar 74 connects to upper vertical support column 44 (discussed in more detail below). FIG. 1 shows two pins (66, 66') but it is understood that any number of pins may be utilized as needed to allow for an adjustment in height of handles 76, 78 from the ground.

Figure 2:
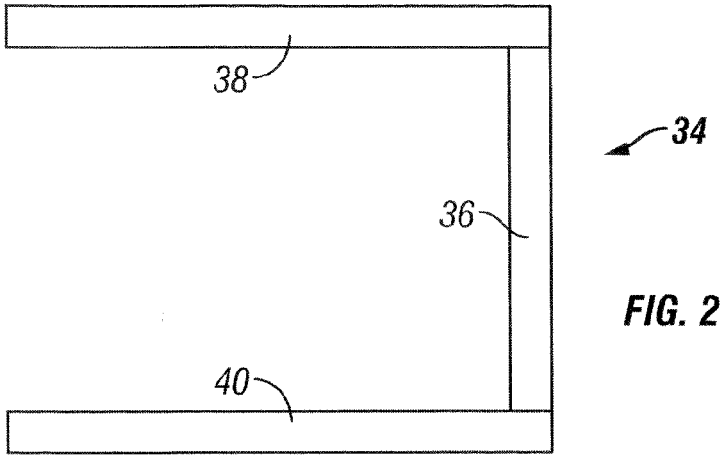
FIG. 2 is a top view of the preferred embodiment, illustrating the base.

FIG. 2 shows the preferred embodiment of base 34. Rear base bar 36 connects from one end to right base bar 38 and from another end to left base bar 40. Therefore, open space exists between left base bar 38 and right base bar 36 opposite rear base bar 36 to allow apparatus 30 to move in close, and around, obstacles so that the patient (not shown) may be positioned underneath overhead support arm 46 for lifting and holding.

Figure 3:
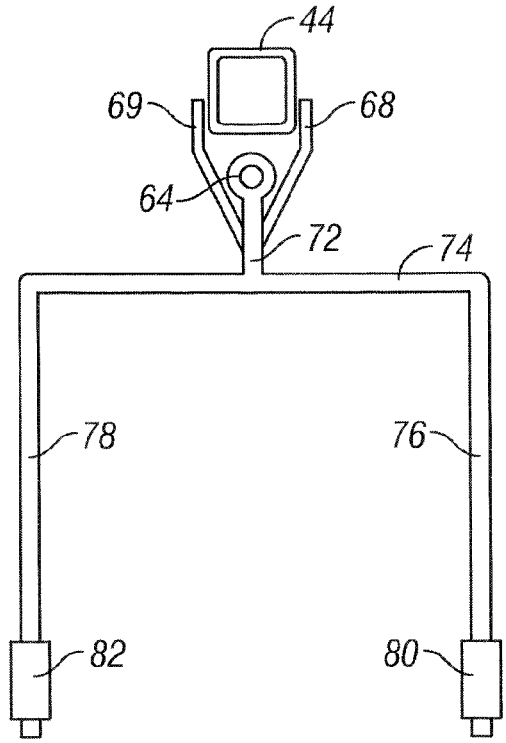
FIG. 3 is a top view of the preferred embodiment, illustrating the handles.

FIG. 3 is a top view of apparatus 30 showing handles 76, 78 in more detail. Left hand grip 80 attaches to left handle 76. Right hand grip 82 attaches to right handle 78. Handle support bar 74 attaches from one end to left handle 76 and from another end to right handle 78. The attachment of handle support bar 74 to handles 76, 78 may be fixed or handle support bar 74 may be pivotally attached to handles 76, 78 so that handles 78, 78 may rotate in a horizontal manner thereby providing for adjustment in the distance between hand grips 80, 82. The lengths of handles 76, 78 may be extendable/adjustable by any means known in the art. For example, handles 76, 78 may each comprise an inner tube (not shown) slidable in and out of an outer tube (not shown).

Handle support bar 72 connects via orifice 64 disposed on handle support bar end 62 to connecting pin 66 (shown in FIG. 1 and FIG. 4) or to connecting pin 66' (shown in FIG.

1). Bracket arms 68, 69 attach to the left and right side, respectively, of upper vertical support column 44 (left connecting point 70 for bracket arm 68 is shown in FIG. 1) to provide force counter to the gravitational pull exerted against either of connecting pin 66 or connecting pin 66' being employed.

Figure 4:
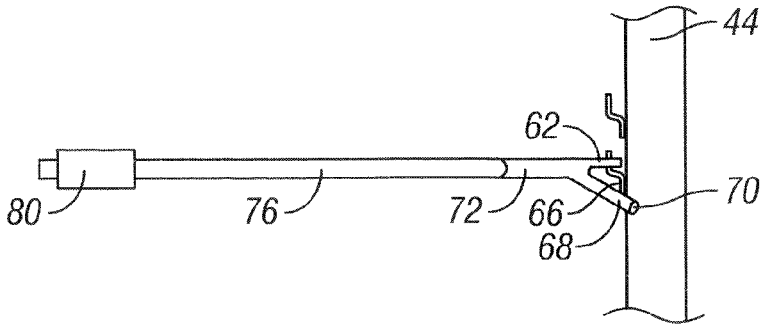
FIG. 4 is a side view of a handles.

FIG. 4 is a side view showing left handle 76 and the means for connecting left handle 76 to upper vertical support column 44 as described above.

All bars and arms of the apparatus 30 may be constructed of any strong rigid material known in the art such as, for example, aluminum or other metals, hard plastic or rubber, carbon fiber, and the like.

The dimensions of apparatus 30 may vary with the goal of ensuring access both between obstacles, such as when navigating around furniture and through hallways and doorways, and around obstacles, such as when the need arises to position apparatus 30 around a chair or bed so that the patient may be positioned underneath overhead support bar 46.

As described, apparatus 30 provides a simple and effective means for positioning apparatus 30 around any obstacle to approach a patient from any side, front or back, lift the patient to any height, and support the patient for standing, sitting, walking, etc. Also, apparatus 30 makes it possible to lift a great amount of weight with minimal effort so that the burden to the patient and to care givers is greatly reduced. Apparatus 30 may thus be used to lift a patient from any position, to help a patient stand and walk, and to help a patient exercise.

EXAMPLE

An apparatus in accordance with the description provided herein was constructed and used successfully as follows:

1. The overall design was as described in the preferred embodiment.
2. The side base bars were spaced approximately 34 inches apart and were approximately 42 inches long.
3. Four wheels were attached to the base to allow movement in any direction.
4. A body harness attached to the overhead support was used to lift and hold the patient.
5. A screw-type jack was used for raising and lowering the patient.
6. A net harness was used for supporting the patient's torso.
7. The apparatus was used successfully in caring for a patient weighing 250 lbs. and measuring 5 feet, 11 inches in height. The patient was able to stand and move about notwithstanding the lack of strength in his legs. The patient was made mobile, was able to get in and out of bed, and was able to use bathroom and bathing facilities.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An ambulation, exercise, and lifting device comprising:

a base frame open on a side thereof;

a plurality of wheels attached to an underside of said base frame;

a vertical support column adjustable in height, said vertical support column including at least one connector extending therefrom;

two horizontal handles attached to a handle support bar, said handle support bar attached to said at least one connector on said vertical support column, said handle support bar including an orifice at one end to attach said handle support bar to said at least one connector;

an overhead support arm pivotally disposed at a pivot point on said vertical support column;

a body harness support bar disposed on said overhead support arm; and a mechanism to rotate said overhead support arm about said pivot point to lift a user.

2. The apparatus of claim 1 wherein said handles are removably attached to said handle support bar.

3. The apparatus ol claim 1 wherein said handles are adjustable in orientation with respect to each other.

4. The apparatus of claim 1 wherein said at least one connector comprises at least one connecting pin.

5. The apparatus of claim 1 wherein said handle support bar further comprises bracket arms at one end that connect to said handles to support the weight exerted on said handles.

6. The apparatus of claim 1 wherein said vertical support column comprises an upper support column slidably and adjustably disposed within a lower support column for height adjustment.

7. The apparatus of claim 1 said body harness support bar is pivotally attached to said overhead support arm from a center point along the length of said body harness support bar.

8. The apparatus of claim 1 wherein said mechanism to rotate said overhead support arm comprises a jack.

9. The apparatus of claim 8 wherein said jack comprises a hydraulic jack.

10. The apparatus of claim 8 wherein said jack comprises a screw-type jack.

11. The apparatus of claim 1 wherein said mechanism to rotate said overhead support arm comprises a crank mechanism and a chain.

12. The apparatus of claim 1 wherein said mechanism to rotate said overhead support arm comprises a motor.

13. The apparatus of claim 1 further comprising a remote control apparatus to control said mechanism.

14. The apparatus of claim 1 further comprising a seat.

15. The apparatus of claim 14 wherein said seat is foldable.

16. The apparatus of claim 1 further comprising a plurality of chains adjustable in length disposed on said body harness support bar.

* * * * *